United States Patent [19]

Billi

[11] 3,939,672

[45] Feb. 24, 1976

[54] CLUTCH DEVICE FOR KNITTING MACHINES

[76] Inventor: Giorgio Billi, Viale Torricelli 23, Florence, Italy

[22] Filed: July 30, 1973

[21] Appl. No.: 383,521

[52] U.S. Cl. ..... 66/155; 192/12 B; 192/27

[51] Int. Cl.[2] ..... D04B 15/66; D04B 9/00

[58] Field of Search ..... 66/56, 50 B, 154 R, 14, 66/26, 155, 138; 192/12 B, 27, 44

[56] References Cited

UNITED STATES PATENTS

| | | | |
|---|---|---|---|
| 2,644,560 | 7/1953 | Kleinschmidt | 192/27 |
| 2,791,108 | 5/1957 | Walker | 66/26 |
| 2,990,043 | 6/1961 | Fink | 192/27 |
| 3,319,749 | 5/1967 | Saeger | 192/27 |
| 3,620,049 | 11/1971 | Misheon et al. | 66/138 |
| 3,783,640 | 1/1974 | Bourgeois | 66/50 B |

FOREIGN PATENTS OR APPLICATIONS

| | | | |
|---|---|---|---|
| 1,098,812 | 1/1968 | United Kingdom | 66/56 |

*Primary Examiner*—Mervin Stein
*Assistant Examiner*—Andrew M. Falik
*Attorney, Agent, or Firm*—Haseltine, Lake & Waters

[57] ABSTRACT

A quick connection or clutching device is positioned between a continuously rotating drive member and a driven member which assures, upon disengagement, an accurate angular positioning of the driven member. In use the device is applied to a circular stocking machine and the like, for the actuation of the cam drum advance and stopping mechanism from the needle cylinder.

1 Claim, 6 Drawing Figures

CLUTCH DEVICE FOR KNITTING MACHINES

SUMMARY OF THE INVENTION

The device according to the present invention substantially includes a continuous circumferential surface preferably attached to the drive member and a cooperating surface having a set of flats or contours attached to the driven member (connected to the cam drum) so as to define together with the circumferential surface, wedge spaces between the two surfaces. A cage member, which holds a plurality of rollers or balls or similar elements, is positioned in said wedge spaces to selectively couple or match the two members upon movement of the cage relative to the space. A movable control and locking unit in the locked position is arranged to lock the driven member which carries the cage member in a release position with the rollers out of contact with the surfaces forming the wedge spaces. Upon release of the locking unit a spring urges the cage member angularly with respect to the driven member in such a direction as to bring the rollers or equivalent members into contact with the surfaces forming the wedge spaces to effect the coupling and movement of the driven member. It is obvious that the cylindrical surface and flats surface could be reversed with the cylindrical surface on the driven member and the flat surface on the drive member.

In the device the locking unit includes a radically movable assembly which includes a rigid retaining tooth and a resiliently yieldable retaining tooth. The rigid tooth is designed to cooperate with a set of peripheral stops on the cage member, while the yieldable retaining tooth is wedge-shaped to cooperate with similarly shaped wedge seats on the periphery of the driven member to stop and center the driven member after the stopping of the cage member forming the cage and after loading by inertia of the spring which acts on the cage member.

The inclined surface or bank of the seats for the wedge-shaped, yieldable retaining tooth which face the rear with respect to the motion direction extends radially outwardly further than the other inclined surface and is inclined at an angle corresponding to the cooperating side of the wedge tooth to impose an eventual angular return of the driven member so as to assure the centering thereof.

The present invention is particularly suitable for use with the electronic control system for knitting machines described in U.S. application Ser. No. 387,514 filed Aug. 10, 1973, however is not restricted to use with such a type of control system.

The invention will be better understood following a reading of the specification with reference to the accompanying drawing, which illustrates a preferred embodiment. In the drawing.

Figure 1:
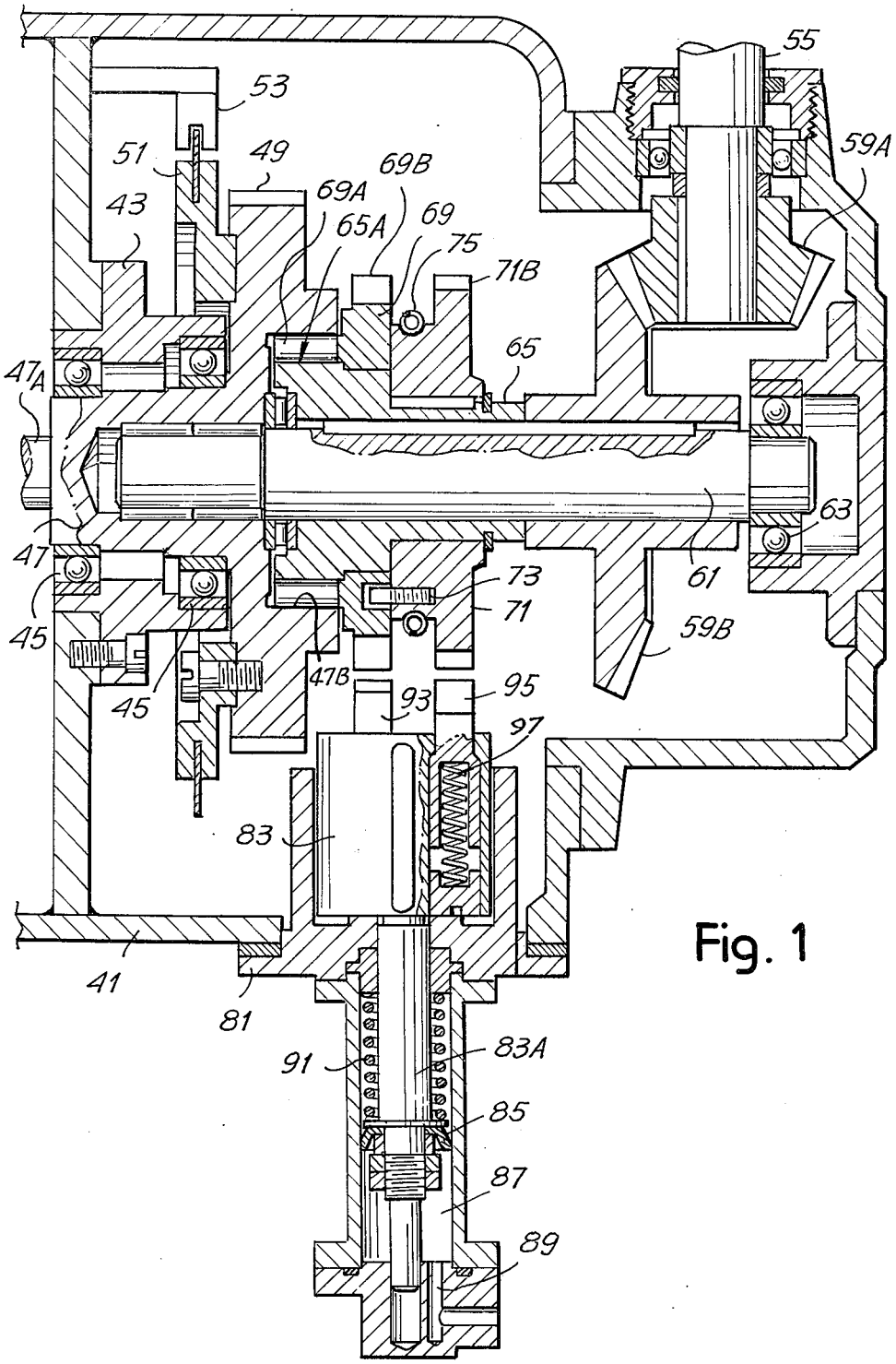
FIG. 1 is a sectional view taken longitudinally through the axis of a quick clutch or coupling according to the present invention adapted to be positioned in the drive chain between the needle cylinder and the cam drum.
Figure 3:
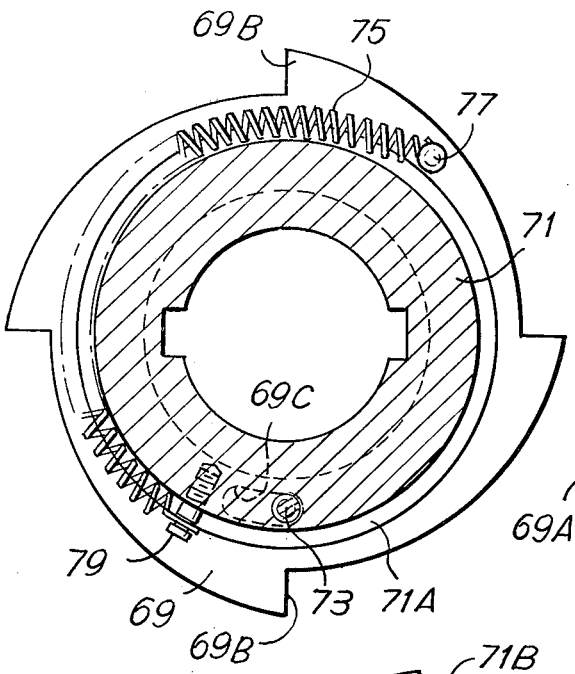
FIGS. 3, 4, 5 and 6 illustrate views and cross-sections taken along the line III—III, IV—IV, V—V of FIG. 2, and an explanatory cross-section taken through the coupling.
Figure 2:
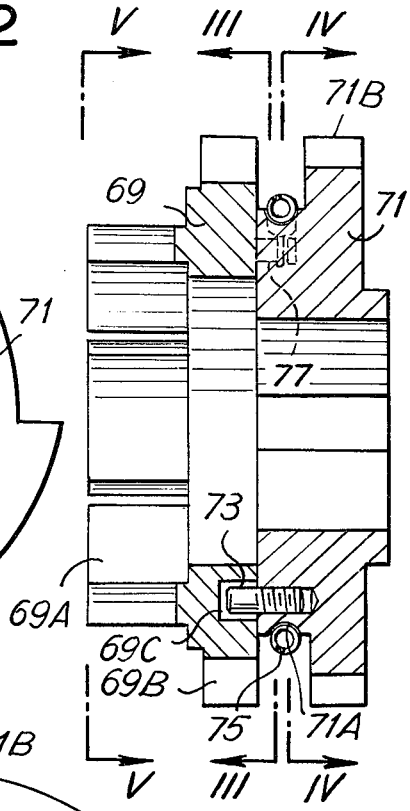
FIG. 2 illustrates an enlarged detail of some of the inner members illustrated in FIG. 1.
Figure 4:
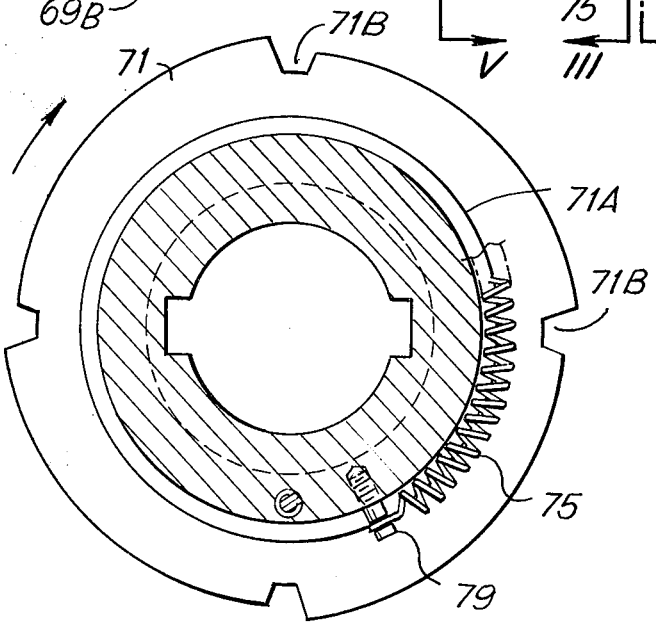
Figure 5:
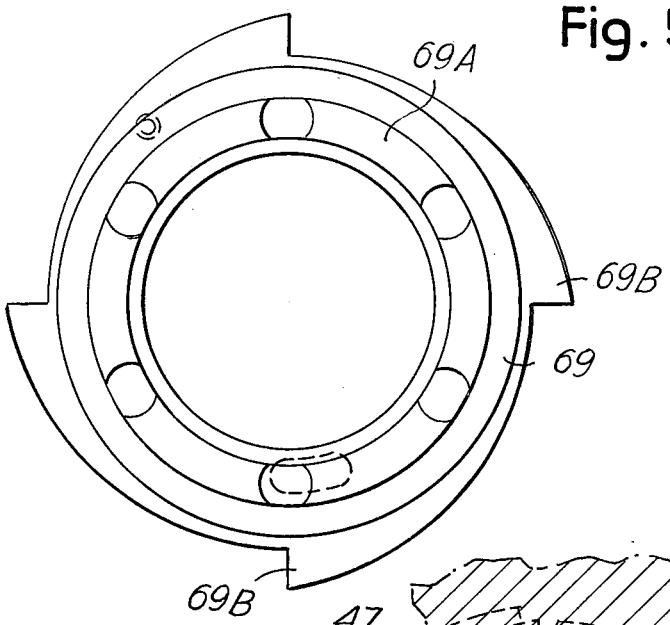

According to the drawing, in a casing 41 of a stocking machine a support 43 is designed to support, by means of bearing 45, a rotary body 47, whose outer end 47A is connected to a drive mechanism (not shown) kinematically coupled to the needle cylinder motion thus forming a drive member. This drive may be direct or may include a reduction system to reduce the number of revolutions of body 47 per revolution of the cylinder. A gear wheel 49 is integrally secured to the rotary body 47 so as to provide for a manual motion, for instance, by a crank. An insulating disk 51 is also an integral part of rotary body 47 and includes suitable contacts designed to periodically and operatively cooperate with a fixed contact 53. This arrangement initiates signals to a control device to indicate rotations or positions of the drive mechanism and thus provide a synchronous count of rotations of the cylinder to the control system.

The rotary member 47 presents, at the end opposite the outer end 47A, a cup-shaped recess forming a cylindrical surface 47B designed to form one of the two surfaces of a free wheel coupling or gear connection to kinematically couple the drive member (needle cylinder) with the driven member (the program cam drum). Shaft 55 forms a part of a drive for the actuation of the driven portion.

The shaft 55 is coupled by means of a pair of gears 59A, 59B to a shaft 61 extending coaxial to the rotary member 47 and supported by means of a needle bearing in the interior of the member 47 on one side and with a bearing 63 on the other.

Figure 6:
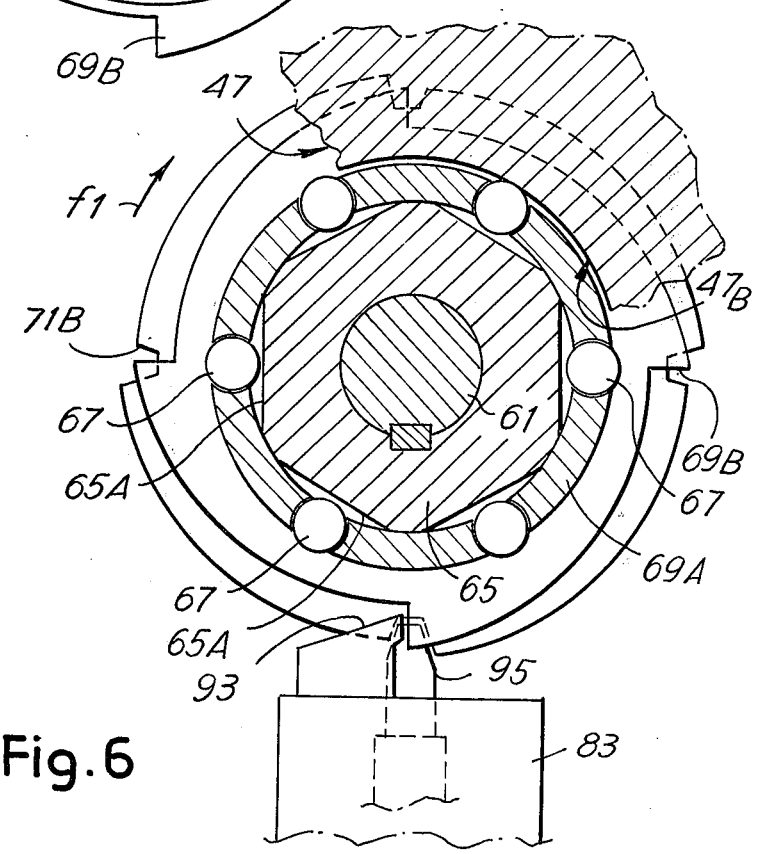

A tubular body 65, is fixedly secured to shaft 61 and extends axially into the interior of the cup-shaped recess defined by the surface 47B in the body 47. The portion of said body 65 extending into said recess has an exterior periphery formed with six flat surfaces 65A joined by six cylindrical portions (FIG. 6). The surface 65A of the body 65 represents the other one of the two surfaces of the free wheel coupling to kinematically connect the drive member to the driven member.

Rollers 67 are interposed between the surfaces 47B and 65A through which the coupling and the release of shafts 61, 55 respectively are actuated. The rollers 67 are retained by a cage formed by arms 69A extending axially from an annular member 69. Member 69 is attached to, but angularly movable with respect to the body 65, and is provided with a set of peripheral teeth 69B with a radial flank and a continuous profile between one tooth and the next. A second annular member 71 is fixedly secured to the body 65, and the rear of said member 71 is adjacent the front of annular member 69 and is provided with a pin 73 designed to penetrate into an arcuately elongated slot 69C, in the front opposite surface of the annular member 69. In this way, a restricted angular movement of the cage and roller assembly is possible, with respect to the units 71, 65, 61, which in turn form the driven member of the free gear coupling and lead to the cam drum. The member 71 is also provided with an annular race 71A, in which a helical spring 75 is partly accommodated. One of the ends of said spring is fixed to a pin 77 of the annular member 69 of the roller cage 69A, while the opposite end of said spring 75 is anchored to a pin 79 extending outwardly in a radial direction from the race 71A of the member 71. The arrangement of the spring 75, the pin 73, and the elongated slot 69C is such that the spring 75 tends to move the cage in the direction which causes the wedging of the rollers 67 between the surfaces 47B and 65A. At the same time and as a result the pin 73 bears against the bottom of the elongated slot 69C. With relative movement of the members 69 and 71 opposite to that according to which they are angularly urged by the spring 75 the rollers 67 can be positioned in an intermediate position of the flats of the outer surface 65A of the driven member 65, the free wheel or gear coupling being unlocked in this way.

The member 71 is further provided with an outer profile with recesses 71B which correspond in number, and approximately in position, to the radial banks or sides of the teeth 69B of the member 69 of the roller cage.

In the casing 41 a support 81 is accommodated, and provides a radial guide (with respect to the axis of the members 47, 61) for a locking unit formed by a head 83 and by a stem 83A, the latter carrying a packing 85 in the manner of a piston sliding in a cylindrical seat 87, to form a cylinder-piston system. When said cylinder is fed with compressed air from the inlet 89, the unit 83, 83A is radially urged towards the axis of the members 47, 61, while under the discharge conditions from the cylinder, a spring 91 radially returns unit 83, 83A in the centripetal direction (downwards looking at the drawing). The head 83 presents a stop 93 designed to cooperatively engage the radial shoulders of the teeth 69B in such a manner as to retain the cage 69, 69A of the rollers 67 in a prescribed position. The head 83 also includes a resilient latch 95, slidable in the head 83 and stressed by a small spring 97 in such a manner as to project in a centripetal direction from the head 83 towards the outer profile of the member 71. When extended, latch 95 cooperates with the banks or sides of the recesses 71B. The recesses 71B and correspondingly the active end of the latch 95 are of corresponding wedge-shape as seen in FIG. 6 in such a manner as to assure proper positioning or centering of the member 71 as well as to assure stopping thereof. For this purpose, the side of each of the recesses 71B which is rearward with respect to the rotational motion direction indicatd by the arrows *f*1, is higher than the front side or bank, both to form a positive stop for the latch 95 and to allow an eventual settling of the member 71 with a slight return movement with respect to the advance rotational direction.

During the operational stages of the machine when the drive member has to rotate, but not the driven member, that is, when and until the drive 65, 61, 55 must be or released with respect to the member 47, 47A, the unit 83, 83A, is inserted to act on the teeth 69B and on the recesses 71B in the arrangement shown in FIG. 6. Under these conditions, the kinematic chain set up by the member 65 (65A), 61, 59A, 59B, 55 is locked in a determined angular position and thus the program cam drum is locked in a well defined position. The stop 93 retains the annular member 69 of the roller cage 69A in a pre-established position with respect to the member 71, wherein the rollers 69 are positioned approximately at the center of the peripheral flats 65A of the member 65, the member 69 pressing against a side 69B on the stop 93 by effect of the spring 75. In order to obtain and keep these conditions, air pressure is supplied to the inlet 89 for the centripetal advance of the head 83.

When a control pulse, for instance, determines the discharge of the pressurized fluid from the cavity of the cylinder 87, the spring 91 moves the unit 83, 83A in the centrifugal direction. This causes the release of the members 69 and 71 from the unit 83, 83A and the immediate coupling of the members 47 and 65 by effect of the return of the spring 75 in the direction of the arrow f1 indicating the rotation of the drive member 47, 47A. This in turn causes the wedging of the rollers 67 between the drive surface 47B and the driven surface 65A.

In order to interrupt the entraining of the output shaft 55 and lock the driven shaft, the unit 83, 83A is advanced again in the centripetal direction, whereby the stop 93 presses on the teeth of the member 69 and by cooperating with the side 69B locks the cage 69, 69A. With the centripetal advance of the unit 83, the latch 95 contacts the outer profile of the member 71, said latch resiliently returning until said latch is wedged in one of the recesses 71B. This also stops the inertia motion of the driven portion of the free wheel coupling and allows rollers 67 to move to their unwedged position while pin 73 travels in slot 69*c* and member 71 advances with respect to member 69. The higher bank or side of the recess 71B and the wedge contour of the latch 95 serve to return the member 71 should the latter be slightly advanced. The motion of the unit 83, 83A for the locking of the members 69 and 71 also causes the restricted re-loading of the spring 75 to the extent that this spring was unloaded when the rollers were wedged. The rollers return to the intermediate position of the flats 65A.

It is intended that the drawing only illustrates an embodiment given only as a practical demonstration of the invention, said invention being in conditions as to be varied in the forms and arrangements, without however departing from the scope of the concept which informs the same invention.

What is claimed is:

1. In a circular knitting machine having a continuously moving drive member and a driven member, a quick clutch means selectively coupling said continuously moving drive member and said driven member, said quick clutch means including a locking means which assures the locking of the driven member in a prescribed angular position upon disconnection from said drive member, said clutch means including a continuous circumferential surface on one of said members and a set of flats arranged on the other of said members to define with said circumferential surface a plurality of wedge spaces, a cage positioned between said circumferential surface and said set of flats and said cage including a plurality of roller elements confined in said wedge spaces to selectively couple said circumferential surface with said set of flats, said locking means being operatively engageable with said cage to selectively lock said driven member in a release position, and means responsive to disengagement of said locking means from said cage to couple the said circumferential surface with said set of flats, whereby said driven member is operatively connected to said drive member, said locking means including a first radially movable unit including a first rigid retaining tooth and a second radially movable unit including a second wedge-shaped spring-pressed retaining tooth, means for moving said rigid retaining tooth into engagement with one of a plurality of peripheral stops on the cage, and means for moving said wedge-shaped spring-pressed retaining tooth into engagement with one of a plurality of correspondingly shaped indentations on the periphery of said driven member, the configuration of said second spring-pressed wedge-shaped retaining tooth and the corresponding configuration of the indentations on the periphery of said driven member conforming with each other, thereby centering and correcting the stop position of the driven member upon engagement with said second retaining tooth.

* * * * *